US005632853A

United States Patent [19]

Montandon, Jr. et al.

[11] Patent Number: 5,632,853

[45] Date of Patent: May 27, 1997

[54] ADHESIVE CARTRIDGE FOR A DESKTOP BOOK BINDER

[75] Inventors: Eugene N. Montandon, Jr., Minnetonka; Alan P. Lonneman, Plymouth, both of Minn.

[73] Assignee: International Binding Corporation, Minnetonka, Minn.

[21] Appl. No.: 427,857

[22] Filed: Apr. 26, 1995

[51] Int. Cl.[6] ..... B32B 31/00

[52] U.S. Cl. ..... 156/578; 118/257; 412/37

[58] Field of Search ..... 156/578; 118/257, 118/258, 602; 412/4, 8, 37

[56] References Cited

U.S. PATENT DOCUMENTS

| | | | |
|---|---|---|---|
| 427,931 | 5/1890 | Sullivan . | |
| 646,616 | 4/1900 | Allen . | |
| 1,747,581 | 2/1930 | Frazier . | |
| 1,776,006 | 9/1930 | Nairne . | |
| 2,044,365 | 6/1936 | Pederson . | |
| 2,155,011 | 4/1939 | Green . | |
| 2,455,971 | 12/1948 | Bosch . | |
| 2,572,243 | 10/1951 | Cashin et al. . | |
| 2,745,378 | 5/1956 | Labombarde | 118/257 |
| 2,752,619 | 7/1956 | Hodge . | |
| 2,991,753 | 7/1961 | Dearsley | 118/602 X |
| 3,045,593 | 7/1962 | Petterson . | |
| 3,594,837 | 7/1971 | French . | |
| 3,629,043 | 12/1971 | Hoff . | |
| 3,715,260 | 2/1973 | Dornemann et al. . | |
| 3,757,736 | 9/1973 | Anderson . | |
| 3,804,694 | 4/1974 | Blair . | |
| 3,866,568 | 2/1975 | Minami | 118/238 |
| 3,911,517 | 10/1975 | Davis . | |
| 3,919,970 | 11/1975 | Spielvogel | 118/257 X |
| 3,956,057 | 5/1976 | Jung . | |
| 3,973,515 | 8/1976 | DeMand . | |

OTHER PUBLICATIONS

"Sigma Instruction Manual", May 1991, by M.C.E. Company.

"Bound to Stay Open", by Otabind.

"Bound to Look Good", *Publishers Weekly*, 9 Aug. 1991, by Paul Hilts, p. 36.

"Innovations in Binding", *Publishers Weekly*, 14 Sep. 1992, pp. S34 and S36.

"On the Binding Edge of Technology", *Graphics Arts Monthly*, Nov. 1989, pp. 64–66.

"New Developments in Otabind: A Better Mousetrap Gets Better", *Publishers Weekly*, 28 Jun. 1991, by Paul Hilts, pp. 80–82.

Brochure entitled "Baby Pony . . . An Efficient Perfect Binder with Unparalleled Versatility", by Muller–Martini Corp.

"Best of Book Design & Manufacture", *Publishers Weekly supplement*, 1989.

Brochure entitled "PANDA Perfect Binder", by Muller–Martini Corp.

Brochure entitled "1st Impression, The Desktop Bindery", by Avery Dennison.

Brochure entitled "GBC Image–Maker 2000, Electric Image–Maker 3000, Deluxe Plastic Binding Systems", by General Binding Corporation, 1992.

Brochure entitled "Rosback Model 880 Perfect Binder", by F.P. Rosback Co.

Brochure entitled "Planax Perfect–Binder F II", by Brackett Incorporated.

*Primary Examiner*—James Engel

*Attorney, Agent, or Firm*—Sand & Sebolt (List continued on next page.)

[57] ABSTRACT

A desktop book binding device for binding a stack of material such as paper along a stack edge using a cold set aqueous adhesive. The desktop book binding device is an office system having an adhesive storing compartment fluidly connected to a disposable, non-refillable adhesive cartridge with an applicator belt therein. The applicator belt applies adhesive to the plurality of edges when a carriage drives the cartridge along the sheets of paper.

37 Claims, 4 Drawing Sheets

U.S. PATENT DOCUMENTS 3,973,787 8/1976 Staats et al. .
3,980,514 9/1976 Rosette et al. .
3,989,367 11/1976 Jackson et al. .
3,992,741 11/1976 Staats .
3,995,886 12/1976 Staats .
4,009,498 3/1977 Staats et al. .
4,029,422 6/1977 Pillsbury .
4,090,443 5/1978 Gasser .
4,116,750 9/1978 Lewis et al. .
4,117,800 10/1978 Maus et al. .
4,141,100 2/1979 Domroe et al. .
4,339,299 7/1982 Snellman et al. .
4,343,673 8/1982 Smith et al. .
4,366,018 12/1982 Gross .
4,367,116 1/1983 Wiholm .
4,373,985 2/1983 Glendening .
4,408,780 10/1983 Detterman et al. .
4,416,722 11/1983 Bergman et al. .
4,518,296 5/1985 Pearson et al. .
4,531,874 7/1985 Voges .
4,536,012 8/1985 Hume .
4,537,650 8/1985 Coons .
4,564,185 1/1986 Hamlin et al. .
4,565,477 1/1986 Axelrod .
4,588,470 5/1986 Abegglen .
4,606,689 8/1986 Wiholm .
4,707,215 11/1987 Scarlata .
4,748,932 6/1988 Latorre et al. .
4,818,168 4/1989 Battisti .
4,861,212 8/1989 Cordia .
4,863,332 9/1989 Wiholm et al. .
4,898,405 2/1990 Pickering et al. .
4,904,139 2/1990 Champeaux et al. .
4,928,995 5/1990 Pickering et al. .
4,958,974 9/1990 Schenk .
4,975,011 12/1990 Holmberg .
5,039,268 8/1991 Blatia et al. .
5,039,375 8/1991 DeLigt et al. .
5,059,276 10/1991 DeLigt et al. .
5,073,076 12/1991 Parkhill, et al. .
5,152,654 10/1992 Luhman et al. .
5,154,447 10/1992 Tooker .
5,160,234 11/1992 Lazar .
5,179,141 1/1993 Emery et al. .
5,193,962 3/1993 Parker et al. .
5,194,116 3/1993 Davis et al. .
5,240,363 8/1993 Ito et al. .
5,271,794 12/1993 Jarrell et al. .
5,470,386 11/1995 Harris ..... 118/258 X

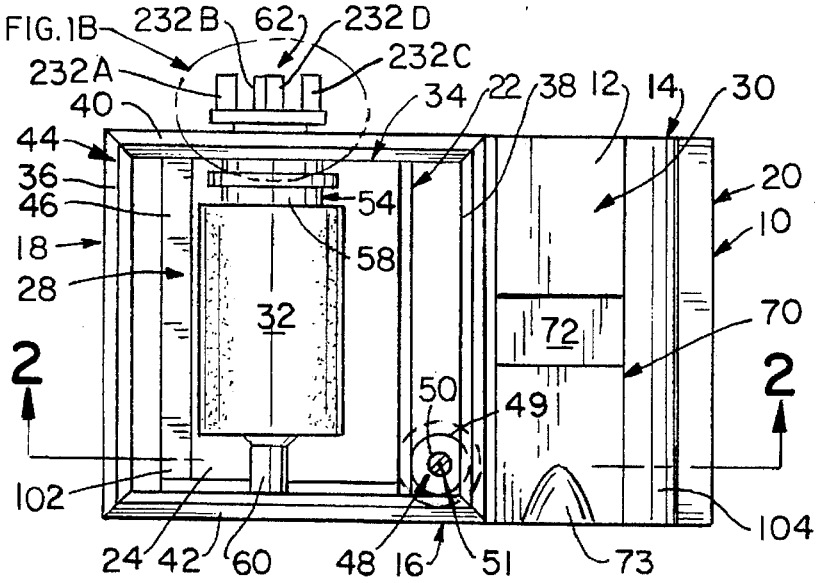
FIG. 1
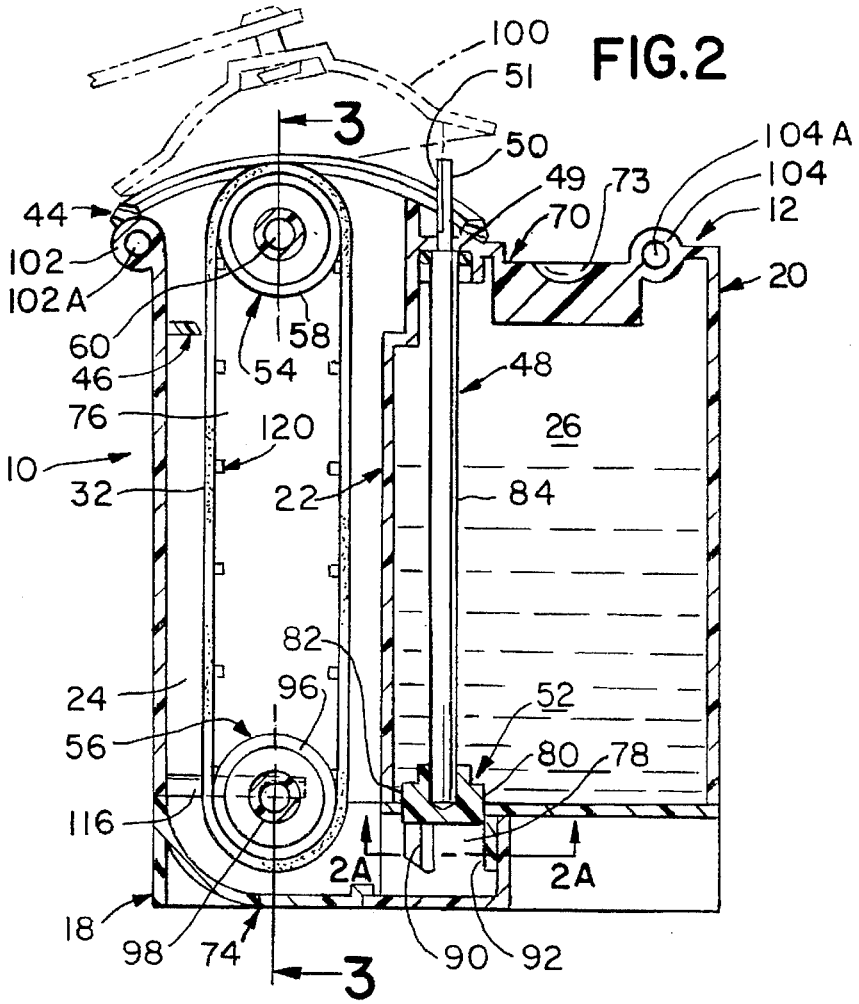

FIG.3A
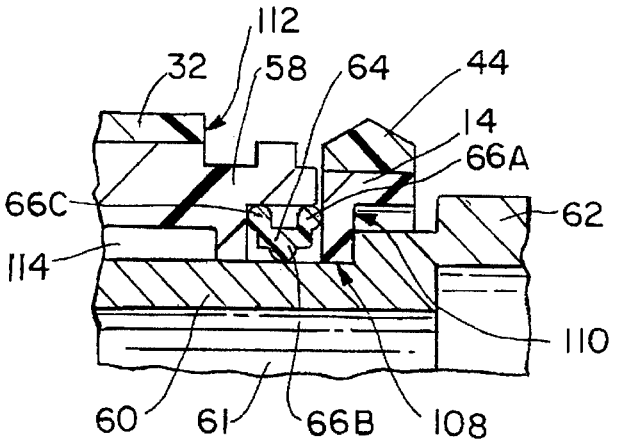
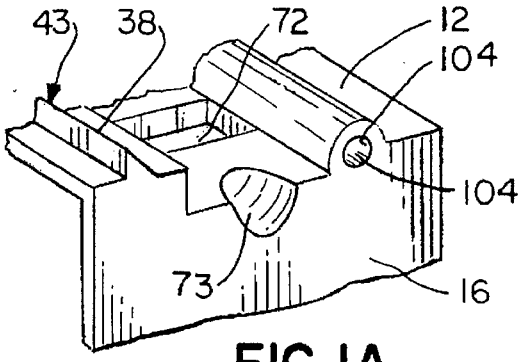
FIG.1A
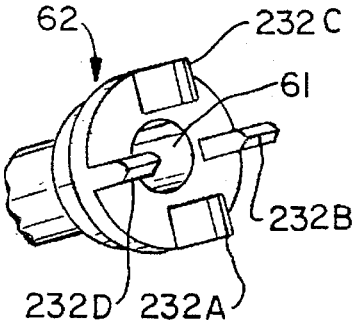
FIG.1B
FIG.3
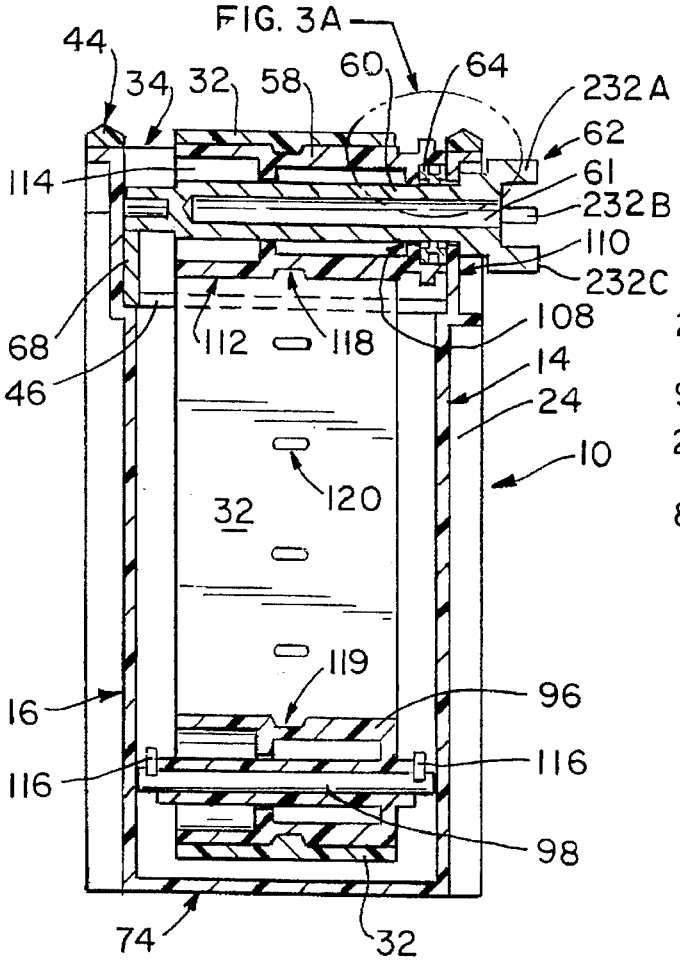
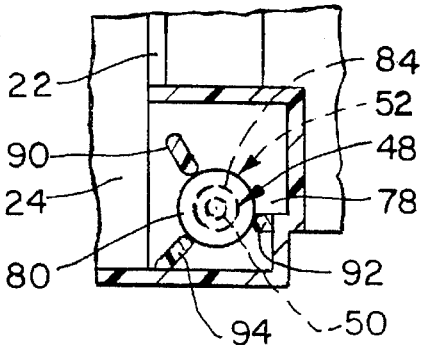
FIG.2A FIG. 4
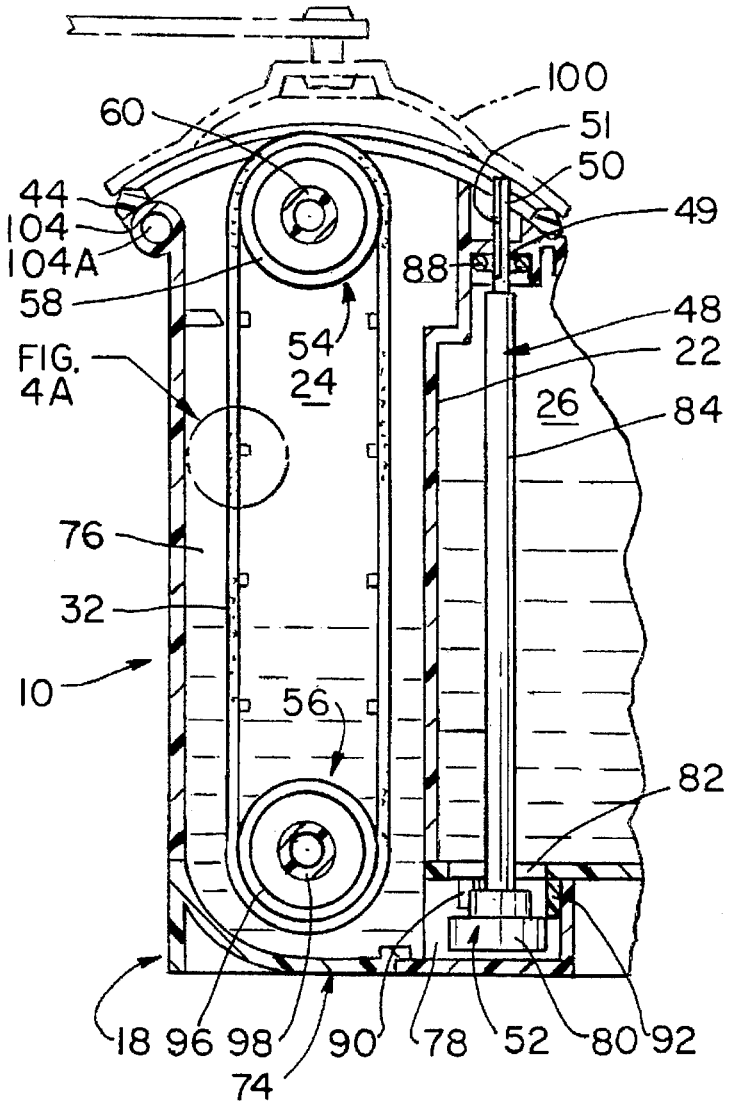
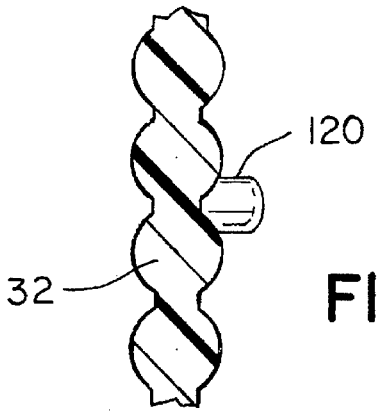
FIG. 4A

ADHESIVE CARTRIDGE FOR A DESKTOP BOOK BINDER

BACKGROUND OF THE INVENTION

This invention relates to an adhesive cartridge in an office product system for binding a plurality of sheets of paper into a soft cover book, manual, publication, report, etc., and more particularly, the present invention relates to a disposable, non-refillable adhesive cartridge that applies flexible, strong, cold set glues to the spine and edges of the book block. This cartridge is used in a desktop, easy to use office system for binding a plurality of sheets which will produce "lay flat" "perfect binding" on demand where short runs (of even one book) may be produced economically and efficiently resulting in a book with a flexible spine which opens flat, without damage to the glue layers that hold it together.

Book and document binding technologies are ancient measured against today's technological standards. Most of the existing processes evolved from circa 1940's technology, predating the use of today's microprocessor based "smart" systems.

Equipment and technology for book preparation and manufacturing is generally represented by either commercial or trade binderies for in line manufacturing of "high quality" volume runs and by a variety of office products manufacturers for casual in-house binding applications. These in-house binding applications use manual or electronic punch and bind plastic, wire spiral systems or alternatively hot-melt glues to make office reports and publications.

Commercial binderies offer a wide variety of binding capabilities and deliver high quality. However, these commercial binderies require minimum production runs that are typically in the thousands of bindings to offset the setup costs of that production run and to support their significant investment in expensive in-line production equipment. For this reason, commercial binderies do not accommodate a vast majority of the soft cover books, manuals, publications, reports, etc. bound today.

Conversely, existing desktop binding office equipment is relatively inexpensive but the technologies are labor intensive. These technologies generally involve a binding process requiring that holes be manually punched in the plurality of sheets of paper followed by an assembly stage where a plastic strip or strips, or plastic or wire binding is wound or otherwise inserted into the holes in a manner that secures the plurality of sheets of paper together. These technologies result in bindings that, while secure, have reduced paper margins, tend to "mousetrap" shut (i.e., books that won't remain open), and/or depend upon bulky plastic combs and/or metal clamps to hold pages together. These methods do not provide a readable, printable regular book spine. With the vastly improved quality and efficiency of producing printed documents, the present quality and process of binding no longer satisfies the quality requirements for binding the increasingly sophisticated output from the combination of desktop publishing software, and in-house laser printer generated output, as one example application. This new generation of business is demanding traditional high quality commercial bindery type binding from a desktop on demand system.

Specifically, today's marketplace requires a desktop binding system capable of delivering professionally bound books, manuals, publications, annual reports, newsletters, business plans, brochures, etc. with the following features:

an office product footprint similar to the desktop computers, photocopiers, and printers (i.e., a desktop book binder); an automated system capable of binding up to one inch thick books (or approximately 300 pages automatically in under one minute); short "on demand"runs of even one book to be economically performed; binding of publications that lie flat and remain open without the use of cumbersome plastic, spiral or wire; production of a flexible, printable regular book spine which opens flat, without damage to the glue layers that hold it together; and recyclability of the publication in its entirety, including the binding.

BRIEF SUMMARY OF THE INVENTION

The invention is part of a complete binding system designed to provide a compact single-unit desktop binding mechanism that is easy and efficient to use in an office environment that is unsophisticated as to binding methodology and which achieves a "perfect" and "lay flat" binding of sheets with a soft cover and flexible spine.

The present invention is a cartridge which is inserted into the desktop binding mechanism or unit where the cartridge is a non-refillable, disposable rigid cartridge which includes a reservoir for containing adhesive to be applied to the edges of the paper sheets to be bound. The cartridge also contains a continuous belt and related belt mechanism positioned along one side of the cartridge which perform the function of transferring adhesive from the reservoir compartment of the cartridge to the surface of the edge of the paper sheets to be bound through a process that includes the combined independent movements of the cartridge in its entirety and the belt surface of the cartridge both which move along the edge of the paper sheets to be bound. Both the cartridge and belt within the cartridge are operably connected to the binding unit into which the cartridge is inserted and of which the cartridge then becomes an integral part.

The opening in the reservoir of the cartridge through which the adhesive flows from the reservoir to the belt is sealed by a cap when the binding unit is not in use to prevent the curing of the adhesive while within the reservoir. This capping extends the life of the adhesive and the cartridge in which the adhesive is contained.

The present invention is a process whereby the binding unit binds a book block, i.e., a stack of paper along a common edge where the stack of paper is aligned and squared. When the unit is activated, the sealing cap on the reservoir is removed from the opening on the cartridge containing the adhesive thereby allowing adhesive to flow from the reservoir to the endless belt and exposing a part of the endless belt to the adhesive. Upon activation, the cartridge moves along the aligned edges of the stack of paper sheets such that the adhesive is applied to the aligned edges by moving the endless belt which itself moves as the cartridge is moved along the aligned edges. The preferred adhesive is a cold set aqueous glue flowable at room temperatures, as opposed to a hot-melt glue which must be heated for application.

The present invention provides many advantages over the prior art. The adhesive cartridge for a book binding machine described herein advantageously allows on demand binding runs of one or just a few bindings where the resulting binding is of a commercial bindery quality. Another advantage of the present invention when used in a binding machine is desktop binding without the need for holes in the paper to be bound. A further advantage is that the cartridge keeps the adhesive separate from the applicator until the cartridge is loaded onto the carriage thereby extending the life of the cartridge.

Still other benefits and advantages of the invention will become apparent to those skilled in the art upon reading and understanding the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein:

FIG. 1 is a top plan view of the adhesive cartridge.

FIG. 1A is an enlarged perspective view of a portion of the cartridge attachable to the carriage on the book binder.

FIG. 1B is an enlarged perspective view of a roller sprocket for driving the applicator belt.

FIG. 2 is a sectional view of the cartridge in FIG. 1 with the front portion of the cartridge cut away at 2—2.

FIG. 2A is an enlarged sectional view of the movable fluid barrier and guides as shown in FIG. 2 taken along line 2A—2A.

FIG. 3 is a sectional view of the cartridge in FIG. 2 taken along line 3—3.

FIG. 3A is an sectional view of the roller, shaft and sleeve as circled in FIG. 3.

FIG. 4 is a partial sectional view of the cartridge as shown in FIG. 3 where the fluid barrier has released the adhesive into the adhesive application chamber.

FIG. 4A is an enlarged view of a wavy embodiment of the applicator belt.

DETAILED DESCRIPTION OF PREFERRED AND ALTERNATE EMBODIMENTS

Figure 5:
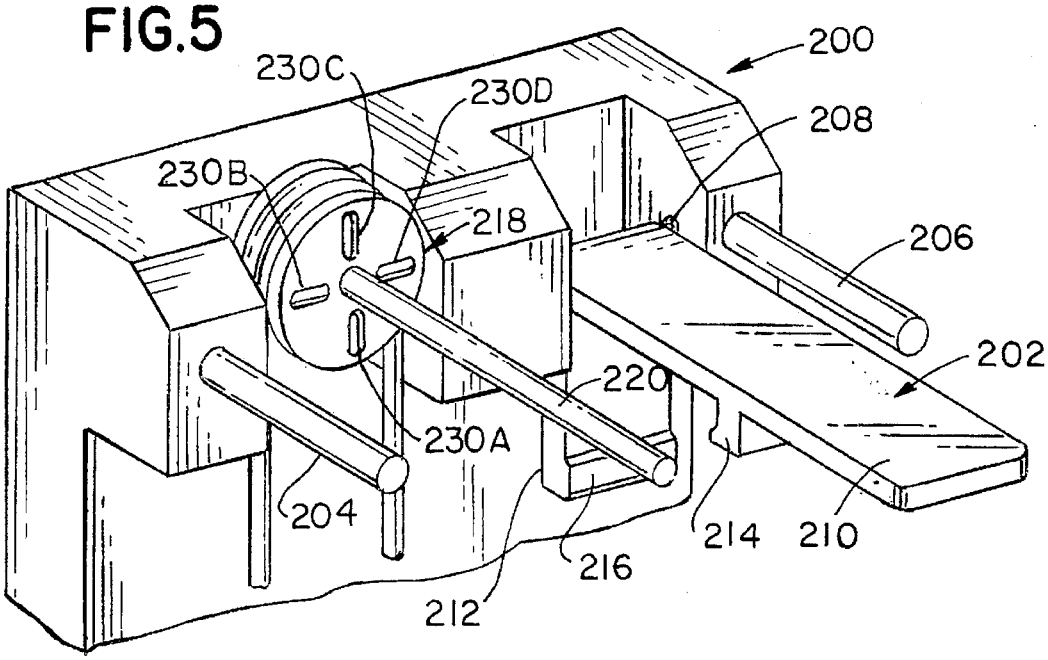
FIG. 5 is a perspective view of the carriage.

Referring now to the drawings, wherein the showings are for purposes of illustrating preferred and alternate embodiments of the invention only and not for purposes of limiting same, FIGS. 1, 2, 3, and 4 best show the overall cartridge, FIG. 5 shows the carriage, and FIGS. 1A, 2A, and 3A show enlargements of portions of the cartridge.

The present invention as shown in FIGS. 1, 2, 3 and 4 is an adhesive applicator cartridge 10. Adhesive applicator cartridge 10 is removably connectable to a compact, single-unit desktop binding machine. The desktop binding machine holds a plurality of sheets of a material such as paper in a stack while the cartridge is moved along a edge of the sheets to apply adhesive thereon. The deposited adhesive binds the edges of the plurality of sheets together resulting in a bound plurality of sheets. The sheets of material may be any type of material having an edge capable of being bound to the edge of another similar sheet of material. The materials could be paper, paper-like materials, plastic transparencies, or any other bindable material.

In the preferred embodiment, the sheets are sheets of paper. The desktop binding machine moves adhesive applicator cartridge 10 lengthwise along a plurality of sheets of paper. During this lengthwise movement, adhesive from adhesive applicator cartridge 10 is deposited on the aligned and squared edges of the plurality of sheets of paper. The deposited adhesive binds the edges together resulting in a bound plurality of sheets of paper, i.e. a soft cover book, pamphlet, etc.

FIG. 1 is a top plan view of adhesive applicator cartridge 10. In the preferred embodiment, cartridge 10 is an adhesive storage receptacle having six sides including a top wall 12, a back or carriage engaging wall 14, a front wall 16, a pair of side walls 18 and 20, and a bottom wall (not shown in this view). Cartridge 10 may have any number of sides oriented in any manner capable of forming an inner cavity for holding adhesive.

Cartridge 10 also includes a center wall 22. This center wall 22 divides the inner cavity created by the sides into an adhesive application chamber 24 and an adhesive storage chamber 26.

Adhesive storage chamber 26 stores adhesive for later application on the aligned and squared edges of the plurality of sheets of paper. Any type of adhesive may be used in adhesive storage chamber 26; however, the use of a cold set, aqueous glue is preferred. A cold set glue is applied and adheres at room temperature thereby eliminating the need for a heater as is required for hot-melt glues (the typical adhesive used in the current technology of in-house binding systems). An aqueous adhesive is biodegradable and is not hazardous or noxious as the standard hot melt glues are.

In one embodiment, the preferred cold-set, aqueous glue is the primer composition disclosed in U.S. Pat. No. 4,536,012 (assigned to the H. B. Fuller Co.) and hereby incorporated by reference. This primer used as a cold set glue sets quickly at room temperature, typically in less than one minute. This cold set glue is also a biodegradable and non-hazardous glue. This cold set glue does not give off noxious fumes as many hot-melt glues do thereby allowing this glue to be used in a desktop atmosphere in an office.

Top wall 12 includes an application section 28 and a connection section 30. An applicator, which in the preferred embodiment is an applicator belt 32, is exposed through an application aperture 34 in application section 28. In the preferred embodiment, application aperture 34 has a pair of flat, opposed edges 36 and 38, and a pair of curved, opposed edges 40 and 42 (the curve is shown in FIG. 2). Each flat edge 36 and 38 is connected to each of the curved edges 40 and 42 resulting in a periphery around application aperture 34 consisting of a flat edge followed by a curved edge followed by a flat edge, etc. Curved edges 40 and 42 curve upward away from flat edges 36 and 38. In another embodiment, application aperture 34 can be any opening capable of exposing applicator belt 32 for applying adhesive to the plurality of sheets of material.

Flat edges 36 and 38 define a flat boundary or plane through which applicator belt 32 extends as the belt 32 projects upward out of adhesive application chamber 24. Curved edges 40 and 42 define a curved boundary above which the belt 32 does not extend as the belt projects out of adhesive application chamber 24. The applicator belt thus extends outside of adhesive application chamber 24 but remains within the confines of curved edges 40 and 42.

In one embodiment, the applicator belt 32 applies adhesive to the aligned edges of material as the cartridge is moved along the plurality of sheets of paper in such a manner that the aligned edges pass over each of the flat edges 36 and 38 while remaining between or within the curved edges 40 and 42 so as to engage the applicator belt 32. In other words, the cartridge is moved along the plurality of aligned edges on the sheets of paper such that the flat edges 36 and 38 transversely cross the aligned edges as the cartridge moves while the curved edges 40 and 42 remain parallel and adjacent to the aligned edges as the cartridge moves, i.e., the edges of the sheets of paper never cross the curved edges.

An engaging seal 44 is positioned along edges 36, 38, 40 and 42 about the periphery of application aperture 34. Seal 44 may be made of any material capable of creating an air-tight seal when a cap 100 (shown in hidden lines) sandwiches seal 44 between cap 100 and top wall 12. In one embodiment, seal 44 is a gasket either made of a sticky material or having a sticky coating thereon to promote sealing. In another embodiment, seal 44 is a rubber seal.

In the preferred embodiment, a doctor bar 46 is located within adhesive application chamber 24 along applicator belt 32. Doctor bar 46 is positioned in close proximity to applicator belt 32 and transversely across applicator belt 32 for removing excess adhesive from applicator belt 32 during rotation of applicator belt 32.

Top wall 12 further includes a device for prohibiting fluid flow from adhesive storage chamber 26 to adhesive application chamber 24 prior to the installation of cartridge 10 in the book binding machine. In the preferred embodiment, this device is an adhesive flow actuator pin 48. Actuator pin 48 has an upper portion 50 extending upward out of top wall 12 through pin aperture 49 which is within application aperture 34 such that the upper tip of upper portion 50 is above edges 36, 38, 40 and 42. Upper portion 50 is slidable downward into adhesive storage chamber 26. Upper portion contains a slot 51.

Applicator belt 32 can be mounted within cartridge 10 in any manner that allows adhesive to be moved from the adhesive application chamber 24 to the stack edge of the stack of material such as paper to be bound, where the stack edge is defined as the plurality of individual aligned edges where each individual edge is on one of a plurality of adjacent sheets of bindable material in a stack. In one embodiment, applicator belt 32 is a flexible belt wrapped around an upper roller mechanism 54 and a lower roller mechanism 56 (shown in FIGS. 2 and 3). Upper roller mechanism 54 includes an upper roller 58, an upper shaft 60 with a roller sprocket 62 attached thereto, and a sleeve 64 (shown in FIGS. 3 and 3A). Upper shaft 60 extends out from each end of upper roller 58.

Connection section 30 can be any mechanism capable of connecting cartridge 10 to the book binding machine. In a preferred embodiment as shown in FIGS. 1 and 1A, connection section 30 has a connector receiving groove 70 extending from wall 14 to wall 16. Groove 70 has a locking notch 72 in the mid section of the groove. A finger hole 73 is diagonally cut out from groove 70 in top wall 12 into front wall 16. A locking mechanism on the book binder interacts with the connection section 30.

FIG. 2 is a side sectional view of the preferred embodiment of adhesive applicator cartridge 10 taken along lines 2—2 in FIG. 1. This view clearly shows adhesive application chamber 24 and adhesive storage chamber 26 created by center wall 22 in the inner cavity created by the sides, which include top wall 12, side walls 18 and 20, and a bottom wall 74, of cartridge 10. Adhesive application chamber 24 is L-shaped with an applicator belt housing portion 76 and a valve detention portion 78. In one embodiment, a valve opening 82 in valve detention portion 78 fluidly connects adhesive storage chamber 26 with adhesive application chamber 24.

In the preferred embodiment, a fluid barrier or stopper 52 acts as a valve in valve opening 82. Adhesive flow actuator pin 48 has upper portion 50 with slot 51 therein that extends outward from top wall 12 through pin aperture 49, and a lower portion 84 positioned within adhesive storage chamber 26. Fluid barrier 52 is connected to lower portion 84 on pin 48. An o-ring 88 seals the aperture that lower portion 84 extends from when lower portion 84 is in an up position as is shown in FIG. 2. As is understood by those skilled in the art, any number of devices could be used in valve opening 82 to control the adhesive flow between adhesive storage chamber 26 and adhesive application chamber 24.

Fluid barrier 52 is seated in valve opening 82 that fluidly connects adhesive storage chamber 26 with adhesive application chamber 24. Fluid barrier 52 is selectively movable out of valve opening 82 into valve portion 78 when adhesive flow actuator pin 48 is pushed downward. Valve portion 78 contains three guide ribs—a first guide rib 90, a second guide rib 92, and a third guide rib 94 (as shown more clearly in FIG. 2A). These guide ribs 90, 92 and 94 guide lower portion 84 of adhesive flow actuator pin 48 from a first position as is shown in FIG. 2 where fluid barrier 52 is seated in valve opening 82 to a second position as shown in FIG. 4 where fluid barrier 52 is detained in valve detention portion 78 at or near bottom wall 74.

The guide ribs 90, 92, and 94 tightly fit around fluid barrier 52 when fluid barrier 52 is in the up position as shown in FIG. 2. When actuator pin 48 pushes fluid barrier 52 downward thereby releasing adhesive from adhesive storage chamber 26, a larger diametrical portion 80 of fluid barrier 52 snaps or pops out of the tight engagement with ribs 90, 92, and 94. After the fluid barrier 52 has snapped out of tight engagement with ribs 90, 92 and 94, the ribs then act as detents by prohibiting larger diametrical portion 80 from easily reentering the area in between the ribs 90, 92, and 94.

Applicator belt 32 is wrapped around upper roller 58 of upper mechanism 54 and a lower roller 96 of lower roller mechanism 56. Upper roller mechanism 54 also includes upper shaft 60 which drives upper roller 58 resulting in the rotation of applicator belt 32. Lower roller 96 is a free rotating roller that is driven by belt 32 to rotate about an attached lower shaft 98.

Application aperture 34 is closable by a cap 100 which in one embodiment is attached to a movable cartridge on the book binding machine. Cap 100 may be any device capable of sealing applicator aperture 34. Cap 100 may be opened and closed by any means resulting in the cap opening as necessary to begin the adhesive application process and closing after the process is complete. Cap 100 is shown in an open position (in dashed lines) in FIG. 2.

Contiguous with top wall 12 in the preferred embodiment is a pair of elongated members 102 and 104 with alignment apertures 102A and 104A therein, respectively, as shown in FIG. 2. Each elongated member is preferably a cylindrical tubular member, however, as those skilled in the art readily understand, these members may be of any configuration such as elongated tubular members of a square, an octagonal, or an X-shape that are capable of promoting alignment of the cartridge with the book binding machine.

Each alignment aperture 102A and 104A extends through cartridge 10 from side wall 18 to side wall 20. These elongated members 102 and 104 with alignment apertures 102A and 104A function as alignment mechanisms for forcing cartridge 10 to properly align with the carriage so that roller sprocket 62 properly meshes with the necessary drive mechanism on the book binding machine. This prevents friction between roller sprocket 62 and the drive mechanism on the carriage.

Connector receiving groove 70, locking notch 72, and finger hole 73 receive the locking mechanism from the carriage 200 resulting in cartridge 10 being securely connected to the carriage. In one embodiment, as discussed subsequently and shown in FIG. 5, the locking mechanism consists of a connector bar 202 pivotably connected to carriage 200. As is readily apparent to those skilled in the art, the locking mechanism may be any mechanism capable of connecting the cartridge to the carriage.

The connector bar 202 locks cartridge 10 to carriage 200 via connector receiving groove 70 and locking notch 72, while finger hole 73 allows for the unlocking of connector bar 202 from connector receiving groove 70 and locking notch 72.

FIG. 3 is a sectional side view of adhesive applicator cartridge 10. This view clearly shows adhesive application chamber 24 as defined by front wall 16, bottom wall 74, back wall 14, and application aperture 34. Applicator belt 32 is rotatably mounted around rollers 58 and 96 within adhesive application chamber 24.

Upper roller mechanism 54 is clearly shown in FIGS. 3 and 3A to include upper roller 58, upper shaft 60, roller sprocket 62, and sleeve 64 with seals 66A, 66B, and 66C. Upper roller 58 has an outer belt engaging surface 112 and a hollow shaft receiving interior 114. Upper shaft 60 is permanently press fit through shaft aperture 108 into shaft receiving interior 114 of upper roller 58 which is in adhesive application chamber 24. This rotatably locks upper roller 58 and upper shaft 60 in adhesive application chamber 24 between front wall 16 and back wall 14. Upper shaft 60 extends out from each end of upper roller 58. Sleeve 64 is U-shaped and slidably mounted on one end of upper shaft 60 where it is sandwiched in between wall 18 and upper roller 58.

Roller sprocket 62 is attached to one end of upper shaft 60 through wall 14 where wall 14 also functions to support upper shaft 60. Roller support 68 supports the other end of upper shaft 60. Roller sprocket 62 is any means of rotatably connecting upper shaft 60 to a drive means on the book binding machine. Roller sprocket 62 remains outside of adhesive application chamber 24 because shaft shoulder 110 restricts roller sprocket 62 from insertion into shaft aperture 108.

The end of upper shaft 60 upon which roller sprocket 62 is attached is rotatably inserted through shaft aperture 108 and therefore roughly supported by shaft aperture 108. When cartridge 10 is attached to carriage 200, an alignment device which is shown as elongated alignment pin 220 in the preferred embodiment is inserted into a pin receiving aperture 61 in upper shaft 60. Elongated pin 220 adds substantial support to upper shaft 60 for holding upper shaft 60 in place with applicator belt 32 tautly wrapped around upper roller 54 and lower roller 56. The other end of upper shaft 60 rotatably rests on roller support 68. Upper shaft 60 is permanently press fit to upper roller 58 such that the rotation of upper shaft 60 results in rotation of upper roller 58.

Lower roller mechanism 56 as shown in FIG. 3 includes lower roller 96 and lower shaft 98. In the preferred embodiment, lower roller 96 and lower shaft 98 are integrally molded together. Lower shaft 98 freely rotates as driven by applicator belt 32. Lower shaft 98 is rotatably held in place about each of its ends by a shaft support 116 which restricts lower shaft 98 from movement toward upper shaft 60. The combination of shaft support 116 with roller support 68 acts as a tensioner to keep applicator belt 32 taut about rollers 58 and 96.

In the preferred embodiment, upper roller 58 has a plurality of notches 118 inwardly cut into the periphery of the roller. These notches engage stubs 120 (as shown in FIGS. 2 and 3) on applicator belt 32 where the stubs project inward from the belt. This notch engaging stub interaction prohibits slippage of applicator belt 32 circumferentially about roller 58 as well as axially along roller 58. In addition in the preferred embodiment, lower roller 96 has a groove 119 inwardly cut into the periphery of the roller which acts to prevent axial slippage of applicator belt 32 off of lower roller 96.

In the preferred embodiment, applicator belt 32 is textured or wavy as shown in FIG. 4A. This wavy surface allows channels of adhesive to form thereby preventing "hydro planing" of adhesive on applicator belt 32 during application which results in better adhesive transfer from applicator belt 32 to the edges of the paper. This belt waviness also decreases any slipping of the belt on the rollers by providing a rougher, more gripping surface. The applicator belt may be of any texture or construction capable of transporting adhesive from chamber 24 to the edges of the sheets of paper.

FIG. 4 shows a side sectional view of adhesive applicator cartridge 10 as is shown in FIG. 2 except fluid barrier 52 is open instead of closed. Fluid barrier 52 is connected to adhesive flow actuator pin 48. As is shown in FIG. 4, fluid barrier 52 is selectively movable out of valve opening 82 into valve detention portion 78 when adhesive flow actuator pin 48 is pushed downward. Larger diametrical portion 80 of fluid barrier 52 is tightly guided along the three guide ribs 90, 92, and 94 from the first position as is shown in FIG. 2 to the second position as shown in FIG. 4 where fluid barrier 52 is against or near bottom wall 74. The larger diameter portion snaps out of the area in between the ribs 90, 92, and 94 and the ribs act as detents by restricting the larger diameter portion from reentering the area in between the ribs 90, 92, and 94.

Cap 100 is closed in FIG. 4. The closing of cap 100 seals both adhesive application chamber 24 and adhesive storage chamber 26 thereby extending the life of cartridge 10 by preventing or reducing the likelihood of drying out and hardening of the adhesive in cartridge 10. A closed cap 100 covers application aperture 34 and the air passage created by slot 51 in pin aperture 49. This air passage is a result of slot 51 extending into adhesive storage chamber 26 when pin 48 is moved downward when cap 100 is closed (slot 51 is outside of chamber 26 when pin 48 is in an upper position as is shown in FIG. 2, while slot 51 is pulled down into chamber 26 when pin 48 is a lower position as is shown in FIG. 4).

Moving cap 100 into a closed position (i.e., from position shown in FIG. 2 to position shown in FIG. 4) over application aperture 34 results in cap 100 engaging upper portion 50 thereby forcing upper portion 50 of adhesive flow actuator pin 48 downward which moves fluid barrier 52. This downward movement of fluid barrier 52 allows the adhesive in adhesive storage chamber 26 to flow into adhesive application chamber 24.

The flow of adhesive under center wall 22 functions similar to the flow of water in a poultry waterer where fluid flows from the storage compartment, under the center wall and into the application compartment. Prior to the downward movement of fluid barrier 52 for the first (and only) time, adhesive application chamber 24 is empty (i.e., no adhesive) as is shown in FIG. 2. After downward movement of fluid barrier 52, a sufficient amount of adhesive drains into adhesive application chamber 24 to even out the fluid level between the adhesive storage chamber 26 and the adhesive application chamber 24 (i.e., the adhesive level in chamber 26 drops while the adhesive flows into chamber 24 to an equilibrium level between the two chambers). The result is that a part of the applicator belt that is approximately around lower roller 96 is covered with adhesive after fluid barrier 52 is opened. The cartridge 10 is then either used in an adhesive applying process and then the cap 100 is closed, or the cap 100 is immediately closed, because sealing of the adhesive holding areas (adhesive application chamber 24, and adhesive storage chamber 26) extends the life of the cartridge 10 by preventing the adhesive from drying out. Failure to close the cap will result in the adhesive drying out.

The closure of cap 100 closes application aperture 34 and the pin aperture 49 therein resulting in the adhesive holding areas being sealed because no air can pass into the storage compartment via either under the center wall 22 or through pin aperture 49. When cap 100 is removed and application aperture 34 is opened, slot 51 in pin 48 acts as an air bleeder by allowing air to bleed in through pin aperture 49 via the slot in pin 48. This bleeding mechanism allows additional adhesive to flow into adhesive application chamber 24 from adhesive storage chamber 26 by allowing air to displace the adhesive that flows under center wall 22. This keeps a sufficient amount of adhesive in contact with applicator belt 32.

FIG. 5 shows a partial view of one embodiment of a front face of a carriage 200 for interacting and connecting to cartridge 10. In this embodiment, the connection or locking mechanism consists of a connector bar 202 pivotably connected to carriage 200 by axle 208. Connector bar 202 is L-shaped with a top portion 210 and a side portion 212. A locking protuberance or tab 214 extends downward from the bottom surface of top portion 210 for engaging locking notch 72. A fulcrum tab 216 extends outward from side portion 212.

In addition in this embodiment, the carriage front face contains a pair of guide supports 204 and 206. These guide supports 204 and 206 are elongated rods that extend outwardly from carriage 200. These guide supports 204 and 206 are inserted into alignment apertures 102A and 104A in tubular members 102 and 104 on cartridge 10 so that cartridge 10 is properly aligned with carriage 200 and securely supported to carriage 200 during the adhesive application process.

In operation, cartridge 10 is connected to carriage 200 on the book binding machine. The book binding machine receives and holds a stack (or plurality of sheets) of material such as paper. The stack is inserted into the binder where one edge on each sheet is aligned with one edge on each of the other sheets. The stack is clamped such that an edge of the stack is squared and aligned for receiving adhesive and a cover.

As described above, the cartridge 10, which in one embodiment is a removable adhesive container or bottle having adhesive therein, has an endless adhesive applicator belt 32 therein which picks up adhesive in the container and transports the adhesive outside of the container where the adhesive is applied to the aligned edge of the stack of paper sheets as the container is moved along that edge. The belt 32 is operably coupled to the binding apparatus such that movement of the cartridge 10 causes movement of the belt 32 through the adhesive in the cartridge 10. The application aperture 34 in cartridge 10 causes movement of the belt 32 through the adhesive in the container. The aperture 34 in cartridge 10 through which the belt 32 extends is closable by a cap 200 when the cartridge 10 is not in use, thereby extending the life of the adhesive therein. The cartridge 10 is replaceable when its supply of adhesive runs low.

In more detail, cartridge 10 is used in a binding system where the first step is inserting a stack of sheets, in the preferred embodiment paper sheets, into the clamping mechanism. The stack of sheets rests upon a squaring plate which is aligned in a first position. The stack of sheets is squared or jogged by the plate so that one edge of the stack of sheets is aligned for binding. The clamping mechanism is activated to securely clamp the sheets together with one aligned stack edge. The plate is removed from contact with the aligned stack edge by rotating the plate into a second position.

The adhesive cartridge 10 up to this point has been in its storage position. A cartridge drive is then activated, resulting in removal of the cap from the applicator aperture thereby exposing a portion of the endless belt 32 for adhesive application. The cartridge 10 moves along the aligned edge of the stack of sheets such that the adhesive is applied to the aligned edge by its moving adhesive application belt 32. Typically, this application step is repeated (one back and forth pass under the stack) and the cartridge returns to its storage position.

In more detail, when adhesive is to be deposited on the stack edge of a stack of bindable material where the stack edge is defined as the plurality of individual aligned edges where each individual edge is on one of a plurality of adjacent sheets of bindable material in a stack, the cartridge drive means is activated in the book binder thereby actuating the cartridge driver or drive gear 218 positioned on the carriage. The rotation of cartridge driver 218 imparts rotation to roller sprocket 62 which is fixedly connected to upper roller 58. This rotation of upper roller 58 causes the rotation of applicator belt 32 and lower roller 96. When this rotation of applicator belt 32 occurs while cartridge 10 is driven along the stack edge, adhesive is deposited on the aligned edges of the plurality of sheets of paper in the stack resulting in a bound plurality of sheets of paper. Cartridge 10 is driven along the stack edge by carriage 200 which is moving along the stack of sheets.

After adhesive application is complete, the cap 100 recovers the aperture 34 through which the adhesive application belt 32 is exposed. In an alternative embodiment, an infrared heater is also supplied and activated so that the adhesive is cured (the heater is also adapted to rotate out of the path of the adhesive container during adhesive application). The preferred adhesive is an aqueous glue flowable at room temperature, as opposed to a hot-melt glue which must be heated for application.

After the adhesive has been so applied, a subsequent step may be performed resulting in the attachment of a cover to the bound papers sheets. A cover is inserted under the aligned edge to which adhesive recently has again been applied in a second two-pass application. The squaring plate is moved back into the first position so that the plate contacts the cover, thereby pressing the cover against the aligned edge of the stacked sheets. The heater is then activated to cure adhesive and secure the cover to the stack of paper. The clamp mechanism opens and tips out of the way for removal of the book or pamphlet having a cover attached to the aligned and glued edges of a stack of paper sheets. The book is then placed in a nipping station of the apparatus where the spine is squared.

Figure 6A:
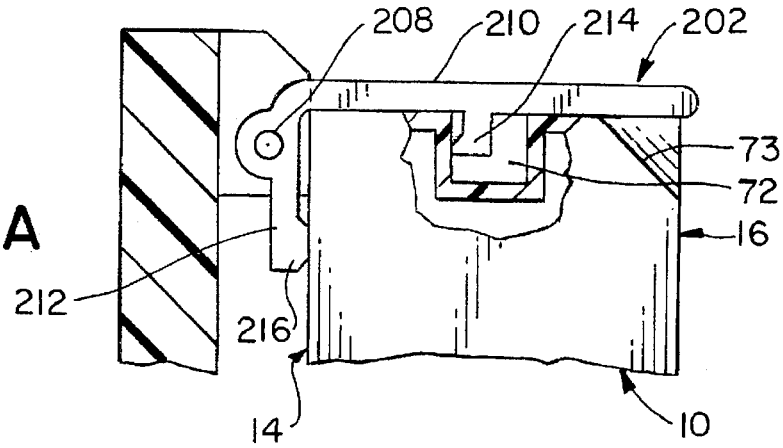
FIG. 6A is a partial sectional view of the connector bar of the carriage engaging the connection area of the cartridge.

The cartridge is removable for replacement when the adhesive supply is depleted. When cartridge 10 and carriage 200 are to be connected, cartridge 10 is slid onto guide supports 204 and 206. The cartridge is then snapped onto connector bar 202 by pushing back wall 14 against fulcrum tab 216 resulting in the rotation of connector bar 202 toward cartridge 10 until locking tab 214 snaps tightly into locking notch 72 as is shown in FIG. 6A. Cartridge 10 is held in place by guide supports 204 and 206 inserted in alignment apertures 102A and 104A while being locked in place by tension points at fulcrum tab 216 and locking tab 214.

This locking of cartridge 10 to carriage 200 locks a cartridge driver 218 on the carriage to roller sprocket 62 of the cartridge. In one embodiment, cartridge driver 218 is a female adaptor (as shown in FIG. 5) with an elongated alignment pin 220 extending therefrom. The elongated alignment pin 220 extends into shaft aperture 108. The female adaptor cartridge driver 218 has four notches or flutes 230A, 230B, 230C and 230D for receiving four engaging tabs 232A, 232B, 232C and 232D on roller sprocket 62 which is in a male adaptor form (as shown in FIG. 1B). The engaging tabs 232A, 232B, 232C and 232D on roller sprocket 62 are securely engaged in flutes 230A, 230B, 230C and 230D such that the rotation of cartridge driver 218 is imparted to roller sprocket 62. Clearly, cartridge driver 218 could be a male adaptor, and roller driver a female adaptor. Furthermore, roller sprocket 62 and cartridge driver 218 could be any other type of connectable means.

Figure 6B:
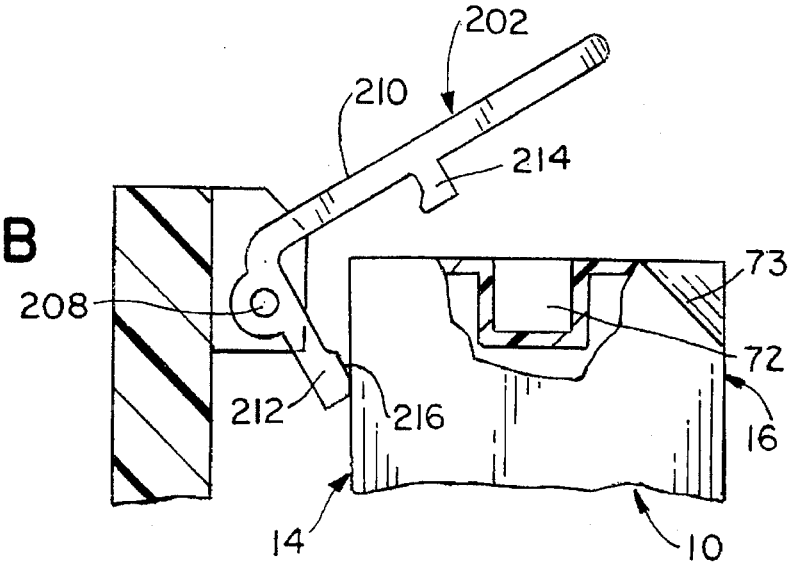
FIG. 6B is a partial sectional view of the connector bar of the carriage disengaging the connection area of the cartridge.

To remove cartridge 10, connector bar 202 is pulled upward away from cartridge 10 resulting in the disengagement of locking tab 214 from locking notch 72 thereby allowing the slidable removal of the cartridge from the carriage. Connector bar 202 is shown being removed from locking notch 72 in FIG. 6B.

The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

Having thus described the preferred and alternative embodiments, the invention is claimed as follows:

1. A cartridge for applying adhesive to a stack edge of a stack of bindable material held in a binding machine, the stack edge being defined as a plurality of aligned edges of adjacent sheets of stacked bindable material, the cartridge comprising:

an applicator belt for applying adhesive to the stack edge, the applicator belt having an inner surface with a plurality of notch engaging stubs;

an adhesive application chamber housing the applicator belt therein and including an aperture through which a portion of the applicator belt is exposable;

means for moving adhesive from the adhesive application chamber to the stack edge, the means including a pair of rollers and a sprocket, the pair of rollers affixed within the adhesive application chamber such that the belt is rotatable around the pair of rollers, the rollers further including an arcuate outer surface with a plurality of inwardly cut notches therein for interacting with the notch engaging stubs, and the sprocket coupled to one of the rollers and operable to rotatably drive the applicator belt; and, an adhesive storage chamber in selective fluid communication via a fluid passageway with the adhesive application chamber.

2. A cartridge for applying adhesive to a stack edge of a stack of bindable material held in a binding machine, the stack edge being defined as a plurality of aligned edges of adjacent sheets of stacked bindable material, the cartridge comprising:

an applicator belt for applying adhesive to the stack edge;

an adhesive application chamber housing the applicator belt therein and including an aperture through which a portion of the applicator belt is exposed;

an adhesive storage chamber in selective fluid communication with the adhesive application chamber;

a movable fluid barrier for selectively prohibiting adhesive flow through a fluid passageway from the adhesive storage chamber to the adhesive application chamber; and, an actuator pin connected to the movable fluid barrier for interacting with a cover to allow fluid flow from the adhesive storage chamber to the adhesive application chamber, where the cover is for sealably covering the aperture.

3. The cartridge in claim 2 wherein the cartridge includes means for moving adhesive from the adhesive application chamber to the stack edge.

4. The cartridge in claim 3 wherein the means for moving adhesive includes the applicator belt.

5. The cartridge in claim 3 wherein the means for moving adhesive includes at least one roller.

6. The cartridge in claim 5 wherein the means for moving adhesive further includes a second roller and the applicator belt rotatable around the rollers.

7. The cartridge in claim 2 wherein the adhesive storage chamber has a cold set glue therein.

8. The cartridge in claim 6 further comprising belt slack removal means for removing slack from the applicator belt resulting in the belt being tautly rotatable about the rollers.

9. The cartridge in claim 2 further comprising a wall between the adhesive application chamber and the adhesive storage chamber.

10. The cartridge in claim 2 further comprising a bleeder hole in the adhesive storage chamber that selectively allows air into the adhesive storage chamber.

11. The cartridge in claim 2 further comprising carriage engagement means for securing the cartridge to a movable carriage, the carriage engagement means including at least one elongated tubular hole extending at least partially through the cartridge for supporting the cartridge on the biding machine.

12. The cartridge in claim 2 further comprising a doctor blade adjacent the applicator for removing excess adhesive from the applicator.

13. The cartridge in claim 2 wherein the cartridge includes a top with the adhesive application chamber aperture therein defined by a pair of flat, opposed edges and a pair of curved, opposed edges where each flat edge is connected to each curved edge.

14. The cartridge in claim 13 further comprising a seal attached to the curved and flat edges for sealing the receptacle when the removable cover is closed.

15. The cartridge in claim 13 wherein the adhesive applicator belt is rotatable within the receptacle and extends partially outside of the planar boundary defined between the pair of flat edges while remaining inside of the curved boundary defined between the pair of curved edges.

16. The cartridge in claim 2 wherein the applicator belt has a wavy surface.

17. The cartridge in claim 2 wherein the applicator belt has a textured surface.

18. The cartridge in claim 2 wherein the applicator belt has an inner surface with a plurality of notch engaging stubs.

19. The cartridge in claim 2 wherein the aperture is defined by a pair of flat, opposed edges and a pair of curved, opposed edges.

20. The cartridge in claim 19 wherein at least one of the rollers has an arcuate outer surface with a plurality of inwardly cut notches therein.

21. The cartridge in claim 20 wherein the applicator belt has an inner surface with a plurality of notch engaging stubs for interacting with the inwardly cut notches.

22. The cartridge in claim 2 wherein the pair of rollers includes an upper roller rotatably affixed within the adhesive application chamber with the sprocket coupled thereto, and a lower roller rotatably affixed within the adhesive application chamber.

23. The cartridge in claim 2 wherein the movable fluid barrier includes a stopper.

24. A cartridge for use with a binding machine, said cartridge for applying adhesive to a stack edge of a stack of bindable material held in the binding machine, the stack edge being defined as a plurality aligned edges of adjacent sheets of stacked bindable material, the cartridge comprising:

a plurality of sides including a front wall, an opposing back wall, and a pair of side walls adjacent to each of the front and back wall;

a base connected to at least one of the plurality of sides, whereby the base and the plurality of sides define a chamber;

a top connected to at least one of the sides, where the top includes an aperture;

an adhesive applicator in the chamber with a portion extending out of the aperture for applying adhesive to the plurality of edges to be bound;

at least one elongated tubular surface defining a hole extending at least partially through the cartridge for supporting the cartridge on the binding machine; and, a connection mechanism including a connector receiving groove for receiving a connector from the binding machine, a locking notch for locking the connector to the cartridge, and a finger hole useful in unlocking the connector from the cartridge.

25. The cartridge in claim 24 wherein the chamber includes an adhesive application compartment housing the adhesive applicator, and an adhesive storage compartment for storing the adhesive.

26. The cartridge in claim 25 further comprising a wall in between the adhesive application compartment and the adhesive storage compartment, and means for opening a fluid passageway in the wall to allow fluid flow from the adhesive storage chamber to the adhesive application chamber.

27. The cartridge in claim 24 wherein the connector receiving groove comprises a groove in the top of the cartridge having the locking notch which includes an inwardly extending notch.

28. The cartridge in claim 24 wherein the connector receiving groove comprises a groove in the top of the cartridge having both the locking notch which includes an inwardly extending notch, and the finger hole which is inwardly extending.

29. The cartridge in claim 24 wherein the at least one elongated tubular surface includes a first and second elongated tubular surface, each tubular surface defining a hole having an opening in one of the plurality of sides.

30. The cartridge in claim 29 wherein the first and second elongated tubular surfaces are parallel to one another.

31. A cartridge for applying adhesive to a stack edge of a stack of bindable material held in a binding machine, the stack edge being defined as a plurality of aligned edges of adjacent sheets of stacked bindable material, the cartridge comprising:

a receptacle including a plurality of sides including a front wall, an opposing back wall, and a pair of side walls adjacent to each of the front and back wall;

the receptacle further including a base connected to at least one of the plurality of sides; and further including a top connected to at least one of the sides, where the top includes an aperture;

an applicator belt for applying adhesive to the stack edge, the belt having a nonplanar surface;

an adhesive application chamber defined within the receptacle by a center wall, the adhesive application chamber housing the applicator belt therein and including the aperture through which a portion of the applicator belt is exposable, the aperture defined by a pair of flat, opposed edges and a pair of curved, opposed edges;

means for moving adhesive from the adhesive application chamber to the stack edge, the means including a pair of rollers and a sprocket, the pair of rollers affixed within the adhesive application chamber such that the belt is rotatable around the pair of rollers, and the sprocket coupled to one of the rollers and operable to rotatably drive the applicator belt;

an adhesive storage chamber defined within the receptacle by the center wall, the adhesive storage chamber in selective fluid communication via a fluid passageway with the adhesive application chamber;

an actuator pin connected to a movable fluid barrier for selectively prohibiting adhesive flow through the fluid passageway from the adhesive storage chamber to the adhesive application chamber;

connection means for removably connecting the cartridge to the binding machine, the connection means including a groove in the top having an inwardly extending notch and an inwardly extending finger hole; and, a pair of parallel elongated tubular surfaces spaced apart from each other and each defining a hole extending at least partially into the cartridge for supporting the cartridge on the binding machine.

32. The cartridge in claim 31 wherein the applicator belt has a wavy surface.

33. The cartridge in claim 31 wherein the applicator belt has a textured surface.

34. The cartridge in claim 31 wherein the applicator belt has an inner surface with a plurality of notch engaging stubs.

35. The cartridge in claim 31 wherein at least one of the rollers has an arcuate outer surface with a plurality of inwardly cut notches therein.

36. The cartridge in claim 35 wherein the applicator belt has an inner surface with a plurality of notch engaging stubs for interacting with the inwardly cut notches.

37. The cartridge in claim 31 wherein the movable fluid barrier includes a stopper.

* * * * *